US009388360B2

(12) United States Patent
Zozulya et al.

(10) Patent No.: US 9,388,360 B2
(45) Date of Patent: Jul. 12, 2016

(54) NANOSTRUCTURE OF A REVITALIZING AGENT AND METHOD FOR PRODUCING A STABLE FORM OF A NANOSTRUCTURE OF A REVITALIZING AGENT

(76) Inventors: Vladimir Leonidovich Zozulya, Kharkov (UA); Sergei Leonidovich Zozulya, Kharkov (UA); Sergei Nikolaevich Alexandrov, Kharkov (UA)

( * ) Notice: Subject to any disclaimer, the term of this patent is extended or adjusted under 35 U.S.C. 154(b) by 369 days.

(21) Appl. No.: 13/995,248

(22) PCT Filed: Nov. 16, 2011

(86) PCT No.: PCT/UA2011/000117
§ 371 (c)(1),
(2), (4) Date: Jul. 11, 2013

(87) PCT Pub. No.: WO2012/087261
PCT Pub. Date: Jun. 28, 2012

(65) Prior Publication Data

US 2013/0288936 A1 Oct. 31, 2013

(30) Foreign Application Priority Data

Dec. 24, 2010 (UA) ..... 201015686

(51) Int. Cl.
*C10M 103/06* (2006.01)
*C10M 125/10* (2006.01)
*C10M 177/00* (2006.01)

(52) U.S. Cl.
CPC ..... *C10M 103/06* (2013.01); *C10M 125/10* (2013.01); *C10M 177/00* (2013.01); (Continued)

(58) Field of Classification Search
CPC ..... C10M 125/10; C10M 2201/062; C10M 2201/0623; C10M 103/06; C10M 177/00; C10M 2201/1053; C10N 2210/01; C10N 2210/02; C10N 2210/03; C10N 2210/08; C10N 2220/082; C10N 2230/06; C10N 2230/54; C10N 2230/56
USPC ..... 508/136, 108; 977/811
See application file for complete search history.

(56) References Cited

U.S. PATENT DOCUMENTS

| | | | | |
|---|---|---|---|---|
| 4,229,309 | A | 10/1980 | Cheng et al. | |
| 5,840,666 | A | 11/1998 | Yokouchi et al. | |
| 6,423,669 | B1 * | 7/2002 | Alexandrov et al. | 508/161 |
| 2010/0055440 | A1 * | 3/2010 | Lee | C04B 38/009 428/312.2 |

FOREIGN PATENT DOCUMENTS

| | | |
|---|---|---|
| CN | 1850953 | 10/2006 |
| CN | 101235332 | 8/2008 |

(Continued)

OTHER PUBLICATIONS

International Searching Authority (ISA/RU), International Search Report of the ISA, for PCT/UA2011/000117, Mailing Date Mar. 29, 2012, 1 page.

(Continued)

*Primary Examiner* — James Goloboy
(74) *Attorney, Agent, or Firm* — Beem Patent Law Firm

(57) ABSTRACT

The invention relates to the production of materials which can be used in lubricating compositions for treating friction assemblies and also for restoring the friction surfaces of mechanism and machine parts.

The composition is produced from the products of dehydration of natural and/or synthesized hydrates and/or mixtures thereof at an inherent water removal temperature and dehydration product stabilization temperature of 300-1200° C.

The composition contains oxides from the series MgO and/or SiO2 and/or Al2O3 and/or CaO and/or Fe2O3 and/or K2O and/or Na2O and is a garnet-shaped conglomerate consisting of a nanograin and an amorphous binding phase.

The size of the conglomerate is in a range of 100-100000 nm and the size of the nanograin is in a range of 2-2000 nm.

The claimed method includes a step for stabilizing the dehydration product at a temperature of 900-1200° C. for a period of 1-3 hours, which makes it possible to form a stable conglomerate structure.

7 Claims, 6 Drawing Sheets

(52) U.S. Cl.
CPC . *C10M2201/062* (2013.01); *C10M 2201/0623* (2013.01); *C10M 2201/1053* (2013.01); *C10N 2210/01* (2013.01); *C10N 2210/02* (2013.01); *C10N 2210/03* (2013.01); *C10N 2210/08* (2013.01); *C10N 2220/082* (2013.01); *C10N 2230/06* (2013.01); *C10N 2230/54* (2013.01); *C10N 2230/56* (2013.01)

(56) References Cited

FOREIGN PATENT DOCUMENTS

| | | | |
|---|---|---|---|
| DE | 102004058276 | | 6/2006 |
| FR | 2891333 | | 3/2007 |
| GB | 499338 | | 1/1939 |
| RU | 2057257 | | 3/1996 |
| RU | 2059121 | | 4/1996 |
| RU | 2168538 | | 6/2001 |
| RU | 2168663 | | 6/2001 |
| RU | 2233791 | | 8/2004 |
| RU | 2269554 | | 2/2006 |
| RU | 2356938 | | 5/2009 |
| RU | 2364472 | | 8/2009 |
| WO | 9640849 | A1 | 12/1996 |
| WO | 2006/058768 | | 6/2006 |

OTHER PUBLICATIONS http://5koleso.ru/articles/1517.

* cited by examiner

NANOSTRUCTURE OF A REVITALIZING AGENT AND METHOD FOR PRODUCING A STABLE FORM OF A NANOSTRUCTURE OF A REVITALIZING AGENT

CROSS-REFERENCE TO RELATED APPLICATIONS

This application is a U.S. national stage application of PCT application PCT/UA2011/000117, filed Nov. 16, 2011, and claims the benefit of priority from Ukrainian Patent Application No. a 2010 15686, filed Dec. 24, 2010.

BACKGROUND OF THE INVENTION

The invention relates to the field of nanotechnology and to the nanomaterials production process which can be applied in lubricating compounds for treatment of friction units as well as for restoration of friction surfaces of mechanisms and vehicles parts.

The revitalizant nanostructure is a new step in technical progress. This phenomenon refers to decrease of typical dimensions of materials and their conversion into level of nanophase materials. Properties of such materials may be subject to substantial changes. Separate nanoobjects and organised formations of nanoobjects acquire new properties which are essential for technical application in different technical fields.

The applicant uses the term "revitalizant" as a shortening for the original technical term, whose meaning is "lubricating compound for restoration of friction units", obtained through the certain technology and designed for the process of "revitalization" and which, in its technical essence, means activation or restoration of initial technical parameters or properties of friction surfaces or friction units. The applicants and XADO Company (Ukraine, Kharkov) have been using the original technical terms "revitalizant" and "revitalization" since 1998.

There exists, e.g., the technical solution "Suspension of organic/inorganic nanostructures containing nanoparticles of precious metals" (Patent of Russian Federation No. 2364472 dated Oct. 11, 2007), according to which, the nanostructure is implemented as a polycomplex in a two-phase reaction system consisting of two voluminous contacting immiscible fluids. The polycomplex comprises organic molecules containing 2 or more amino groups as well as particles of precious metals.

The proposed technical solution aims at deriving the revitalizant nanostructure from dehydration products of natural and/or synthesized hydrates and/or their mixtures at the temperature of constitutional water removal and the temperature of the dehydration product stabilization ranging from 300 to 1200° C. In a stable state such revitalizant nanostructure contains oxides from the range: MgO and/or SiO2 and/or Al2O3 and/or CaO and/or Fe2O3 and/or K2O and/or Na2O, and consists of a nanograin and a binding phase. According to the proposed invention, the nanostructure has an amorphous pomegranate-like form, whose dimensions fluctuate from 100 to 100,000 nm, while the dimensions of the grain range from 2 to 2,000 nm. According to the proposed invention, bound water is removed at the temperature of 300-1,000° C., and the product stabilization takes place at the temperature of 700-1,200° C. The amorphous pomegranate-like form of the revitalizant nanostructure is produced through mixing of dehydration products of natural and/or synthesized hydrates, and the binding phase of the amorphous pomegranate-like form is composed of a homogeneous mixture of several oxides from the range: MgO and/or SiO2 and/or Al2O3 and/or CaO and/or Fe2O3 and/or K2O and/or Na2O. The nanograin of the amorphous pomegranate-like form is made up of one or several oxides from the range: MgO and/or SiO2 and/or Al2O3 and/or CaO and/or Fe2O3 and/or K2O and/or Na2O. Hardness of the nanoparticles comprises approximately 7-10 on the Mohs scale.

The description of the technical essence of the proposed technical solution testifies that it is new and can be implemented while formulating and applying lubricating compounds, wherein the initial size of particles in the revitalizant nanostructure corresponds to the dimensions of surface defects (graininess, microroughness). The impact of the revitalizant (lubricating compound) nanostructure on the friction surface causes plastic nanoscale deformation of metal and conversion of the surface layer subject to friction into an active nanostructured state. This also brings about intensive grinding of the metal grains, increase in the density of their interfaces and improvement of conditions for carbon diffusion into the surface (vertically) and into the grains (horizontally).

DETAILED DESCRIPTION

Figure 1:
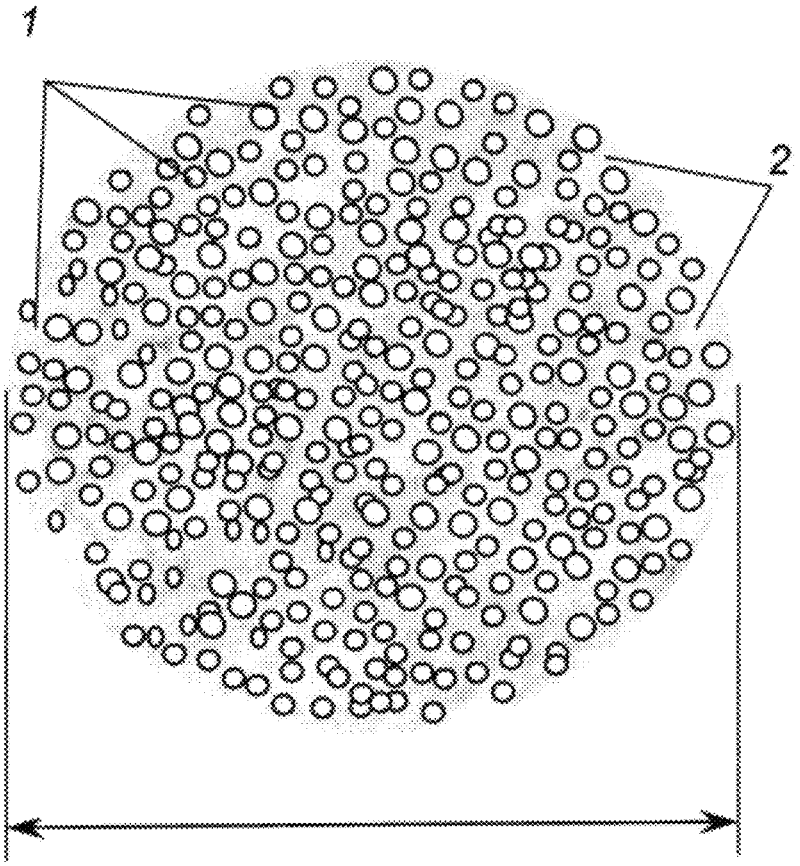
FIG. 1 shows a schematic view of the revitalizant nanoparticle.

Inventive step of the proposed technical solution consists in the following.

Existing lubricating compounds for treatment of friction pairs include metal and non-metal oxides, which as oxides contain products of dehydrated hydrates with the temperature of bound water removal and crystal lattice destruction ranging from 400 to 900° C. In a stable phase such lubricating compounds contain oxides from the range: MgO, SiO2, Al2O3, CaO, Fe2O3, K2O, Na2O. Within the above-stated temperature range (400-900° C.) there takes place elimination of hydroscopic moisture and some water loosely bound in the crystal lattice as well as removal of chemically bound water in the crystal lattice.

In accordance with the proposed technical solution, the revitalizant nanostructure of the amorphous pomegranate-like form with the size ranging from 100 to 100,000 nm and the size of the nanograin being 2-2,000 nm was obtained through removal of bound water at the temperature of 300-1,000° C. Moreover, the technical solution according to the proposed invention also includes the process of stabilization of the dehydration product at the temperature of 700-1,200° C. Therefore, the amorphous pomegranate-like form of the revitalizant nanostructure is composed of mixtures of the dehydration products of natural and/or synthesized hydrates, wherein the binding phase of the amorphous pomegranate-like form is made up of a homogeneous mixture of several oxides from the range: MgO and/or SiO2 and/or Al2O3 and/or CaO and/or Fe2O3 and/or K2O and/or Na2O, and the nanograin of the amorphous pomegranate-like form is constituted of one or several oxides from the range: MgO and/or SiO2 and/or Al2O3 and/or CaO and/or Fe2O3 and/or K2O and/or Na2O. The above mentioned allows obtaining the revitalizant particles with the hardness of approximately 7-10 on the Mohs scale.

The state of the art regarding the method for obtaining the revitalizant nanostructure in the stable form consists in the fact that the method for obtaining nanoparticles of the stable form is inextricably connected with the process of stabilization of these nanoparticles and their interaction among themselves and between friction surfaces after nanoparticles of the revitalizant have reached the friction zone.

There exists the technical solution called "Method for producing nanoparticles" (Patent of Russian Federation No. 2233791 dated Mar. 26, 2002). It handles the synthesis of nanoparticles, wherein nanoparticles are produced under chemical influences or chemical and physical influences, or combinations thereof in the monomolecular layer on the surface of the fluid phase.

Besides, there is another technical solution, whose title is "Organic and inorganic nanostructures and materials containing nanoparticles of precious metals and methods of their production." It deals with formation of a reaction system, containing metallic molecules of precursors and ligands, introduction of a reducing agent thereto and synthesis of nanoparticles. This technical solution allows obtaining a two-phase reaction system, which consists of two contacting voluminous immiscible fluids—hydrophobic and water phases. During this process organic molecules containing 2 and more amino groups act as ligands. Metallic molecules of the precursor are dissolved in the hydrophobic phase, and the ligands—in the water phase, wherein the reducing agent has been introduced.

While investigating the state of the art of "Method for obtaining stable form of revitalizant nanostructure," it was found out that the derived formations of revitalizant nanostructures can be used in production of lubricating compounds consisting of a lubricating medium and a dehydration product of hydrates of natural minerals or mixtures of natural minerals, or synthesized hydrates. The dehydration product contains oxides of MgO and/or SiO2 and/or Al2O3 and/or CaO and/or Fe2O3 and/or K2O and/or Na2O obtained after the removal of bound water and destruction of the crystal lattice at the temperature being below 900° C. The stable phase of the dehydration product is achieved through decomposition of natural minerals or a mixture of natural minerals, or of synthesized hydrates due to their being exposed to the influence of temperature within the range from 900 to 1,200° C. This allows obtaining the decomposition product with the size of 100-100,000 nm.

The proposed lubricating compound can be used in machine-building industry and in different fields of engineering, both in case of initial treatment of friction units and during further operational period of mechanisms and vehicles, for extending overhaul period or during repair and restoration. Physical and chemical properties of the material containing metallic particles largely depend on the nature of metal, form and size of the particles, their orientation, amount and distribution in the structure of the material. The properties of the metal nanoparticles, particularly their form, crystal structure, crystallinity degree as well as optical, electronic and catalyst properties, substantially depend on their size.

Nowadays in scientific and technical literature there are quite many descriptions which deal with different methods of synthesis of precious metal particles, including various ways of synthesis of colloidal particles of precious metals in a voluminous one-phase fluid reaction system. Such synthesis is based on reduction of salts or complexes of metal ions in the presence of stabilizing ligands.

The proposed technical solution aims at improving the method for obtaining the stable form of the revitalizant nanostructure. This method comprises dehydration of natural and/or synthesized hydrates and/or their mixtures at the temperature of bound water removal being below 900° C., wherein oxides from the range MgO and/or SiO2 and/or Al2O3 and/or CaO and/or Fe2O3 and/or K2O and/or Na2O are contained, and introduction of the obtained product onto the friction surface or into the friction zone. The method according to the proposed invention also includes the process of stabilization (obtaining of structurally irreversible form) which follows the process of dehydration. During the process of stabilization the product obtained through the process of dehydration is being stabilized at the temperature ranging from 700 to 1,200° C. within 1-3 hours and the revitalizant nanostructure is being stabilized within 100-100,000 nm. The formation of the stable form of the revitalizant nanostructure is completed through obtaining the stable geometric form (form of rolling), which takes place after the stabilized dehydration product has been introduced onto the friction surface or into the friction zone and which depends on lubrication interval or friction rate and wherein: $h \leq Ra \leq$ the size of the stabilized revitalizant nanostructure, where h—thickness of the lubricating layer or the distance between two friction surfaces, Ra—roughness of the surface. According the proposed invention, the stable geometric form of the revitalizant nanostructure (form of rolling) is obtained during boundary lubrication or boundary friction, wherein $h \leq Ra \leq$ the size of the stabilized revitalizant nanostructure, or during mixed lubrication or mixed friction, wherein $h = Ra \leq$ the size of the stabilized revitalizant nanostructure, or during dry friction, where h tends to 0, $Ra \leq$ the size of the stabilized revitalizant nanostructure.

The proposed method for obtaining the stable form of the revitalizant nanostructure is technologically bound with the method for producing lubricating compound, which comprises the process of dehydration of hydrates of metal and/or non-metal oxides at the temperature of 300-900° C., the process of mixing the product obtained through dehydration with a lubricating medium containing oxides from the range: MgO and/or SiO2 and/or Al2O3 and/or CaO and/or Fe2O3 and/or K2O and/or Na2O. According the proposed solution, the process of dehydration is followed by the process of stabilization of the dehydration product. The process of stabilization is implemented through coordinated exposing to the influence of temperature from 700 to 1,200° C. and time lasting 1-3 hours.

It is found out, e.g., that removal of bound water through dehydration of hydrates from the range MgO and/or SiO2 and/or Al2O3 and/or CaO and/or Fe2O3 and/or K2O and/or Na2O is not only a complicated but also unstable and heterogeneous physical and chemical process. The applicants found out that dehydration at the temperature of 300-900° C. and stabilization at the temperature of 700-1200° C. for hydrates from the range: MgO and/or SiO2 and/or Al2O3 and/or CaO and/or Fe2O3 and/or K2O and/or Na2O, has the transient state (period/condition) within 700-900° C. or the state of partial stabilization, which often causes the reverse effect, i.e. the obtained nanoformations are instable and the sizes of the conglomerate thereof can exceed 100,000 nm. When such nanoformations reach the friction zone, they cause an instable tribotechnical effect or a so-called "temporal effect".

Through the thermogravimetric research method it was detected that weight loss during heating of some hydrates from the range: MgO and/or SiO2 and/or Al2O3 and/or CaO and/or Fe2O3 and/or K2O and/or Na2O, at the temperature from 300 to 700° C. is approximately 32-10 ΔH, mm. Their weight loss substantially decreases, though it yet takes place at the temperature above 700° C. and is approximately 2-1 ΔH, mm, wherein ΔH is proportional to Δ Weight, and is of a stable character.

If being practically applied, the partial stabilization of nanoformations works the following way. When lubricating compound is used, i.e., when the non-stabilized nanoformations reach the friction zone or friction surface, the friction coefficient can be reduced and remain unchanged for some time under the conditions of a stable and regular operation mode. However, if the friction surface is exposed to temporal extreme or uneven loads and further on it again operates in a regular mode, the achieved reduction of the friction coefficient disappears and the friction drastically increases, which cause the reverse effect.

Thus, the inventive step of the proposed method for obtaining the stable form of the revitalizant nanostructure consists in the process of stabilization of the proposed product (revitalizant nanostructure), which depends on the optimal temperature (700-1,200° C.) and time (1-3 hours) conditions, for the formation of the homogeneous binding phase consisting of several oxides from the range: MgO and/or SiO2 and/or Al2O3 and/or CaO and/or Fe2O3 and/or K2O and/or Na2O, as well as the nanograin being made up of one or several oxides from the range: MgO and/or SiO2 and/or Al2O3 and/or CaO and/or Fe2O3 and/or K2O and/or Na2O; and in the process of formation of the stable geometric form (form of rolling), which takes place after the stabilized dehydration product has been introduced on the friction surface or into the friction zone and which depends on the lubrication interval or friction rate, wherein h≤Ra≤the size of the stabilized revitalizant nanostructure.

The Authors believe that the processes of stabilization of the revitalizant nanostructure and formation of the stable forms of rolling in the friction zone not only restore the friction surfaces owning to the carbidization of the surface layer and its conversion into the active nanostructured state (revitalization process) therethrough, but also contribute to the stabilization of friction surface layers and minimization of friction throughout the whole service life of the friction surfaces, and besides nanostructure of the revitalizant actually forms the "roller nanobearings."

FIGS. 1-7 depict the revitalizant nanostructures and processes of formation of the stable forms (forms of rolling) of the revitalizant nanostructures as well as the processes which take place on the modified friction surfaces.

FIG. 1 schematically presents the revitalizant nanoparticle, where the controllable size is shown for friction units with different levels of initial roughness. For convenience the revitalizant nanoparticle is depicted in form of "pomegranate", where its active particles 1 with the size of 2-2,000 nm are presented in form of "grains." The binding phase 2 prevents the particles from contacting. The hardness of the active revitalizant particles is approximately 8-9 on the Mohs scale, and their durability exceeds the durability of the binding phase. Hence, such a particle can be ground to the tiniest "grain."

Hydrates, which are natural nanomaterials in their original state, are used as initial substances for obtaining the revitalizant nanostructure. As a result of dehydration of such substances, i.e. during removal of bound water from the crystal lattice two-phase conglomerated formations consisting of nanoparticles with the size of 2-2,000 nm instead of the initial substance are obtained.

Figure 2:
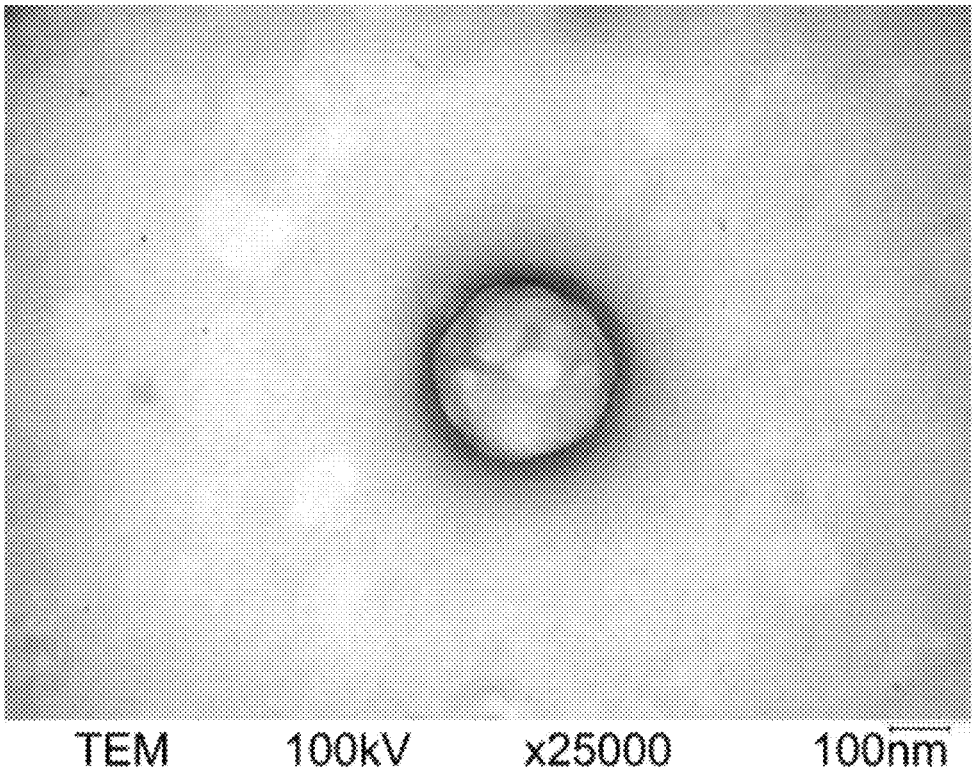
FIG. 2 shows a picture of the initial particle of the hydrate of the revitalizant nanostructure on the base surface of isomorphous carbon as viewed under an electron-microscopic.
Figure 3:
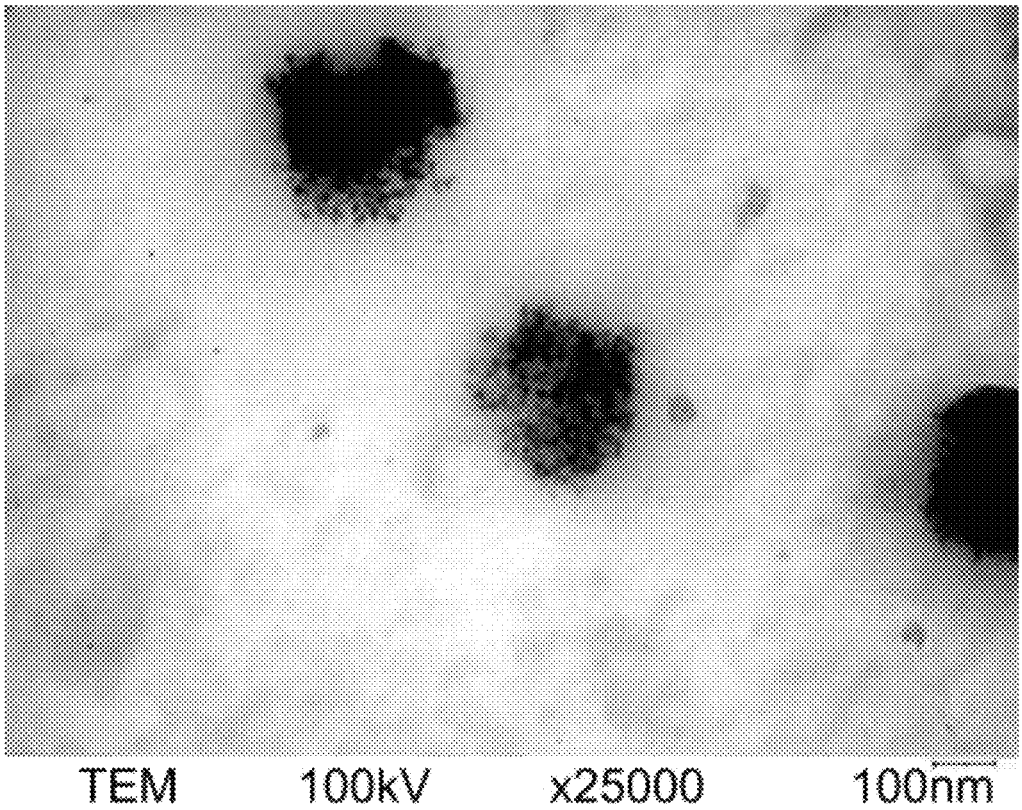
FIG. 3 shows a picture of the initial particles of the hydrate of the revitalizant nanostructure on the base surface of isomorphous carbon after the process of dehydration under an electron microscope.

The above stated facts are confirmed through the conducted electron-microscopic researches (FIGS. 2, 3). FIG. 2 demonstrates the light-field electron-microscopic picture of the initial particle of the hydrate of the revitalizant nanostructure on the base surface of isomorphous carbon. This picture demonstrates nanoscale dimensionality of the revitalizant (approximately 300 nm) and integrity of the initial particle of the hydrate. FIG. 3 shows the light-field electron-microscopic picture of the initial particles of the hydrate of the revitalizant nanostructure on the base surface of isomorphous carbon after the process of dehydration. This picture testifies that removal of bound water from the particle of the hydrate leads to the destruction of its initial integrity and formation of two-phase conglomerated components in form of "pomegranate."

Figure 4:
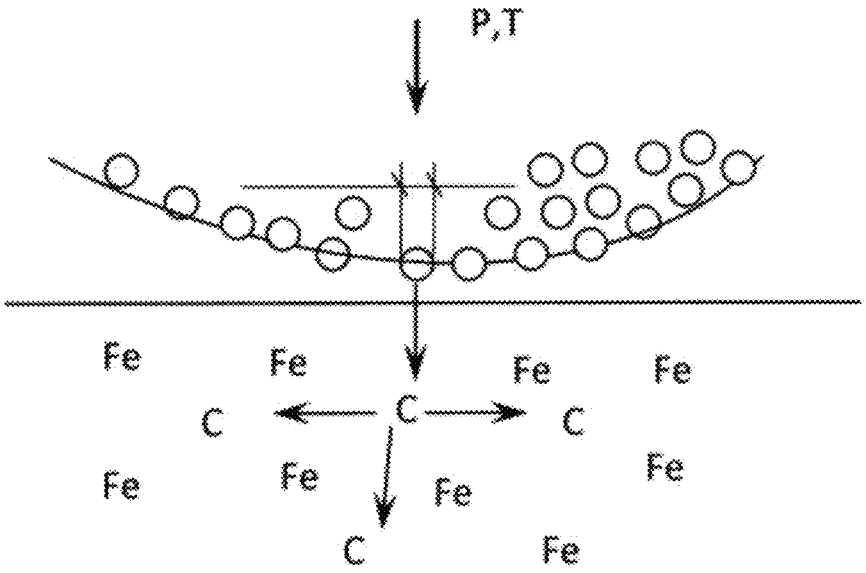
FIG. 4 shows a schematic view of the process of carbidization of the treated surface or friction surface.
Figure 5:
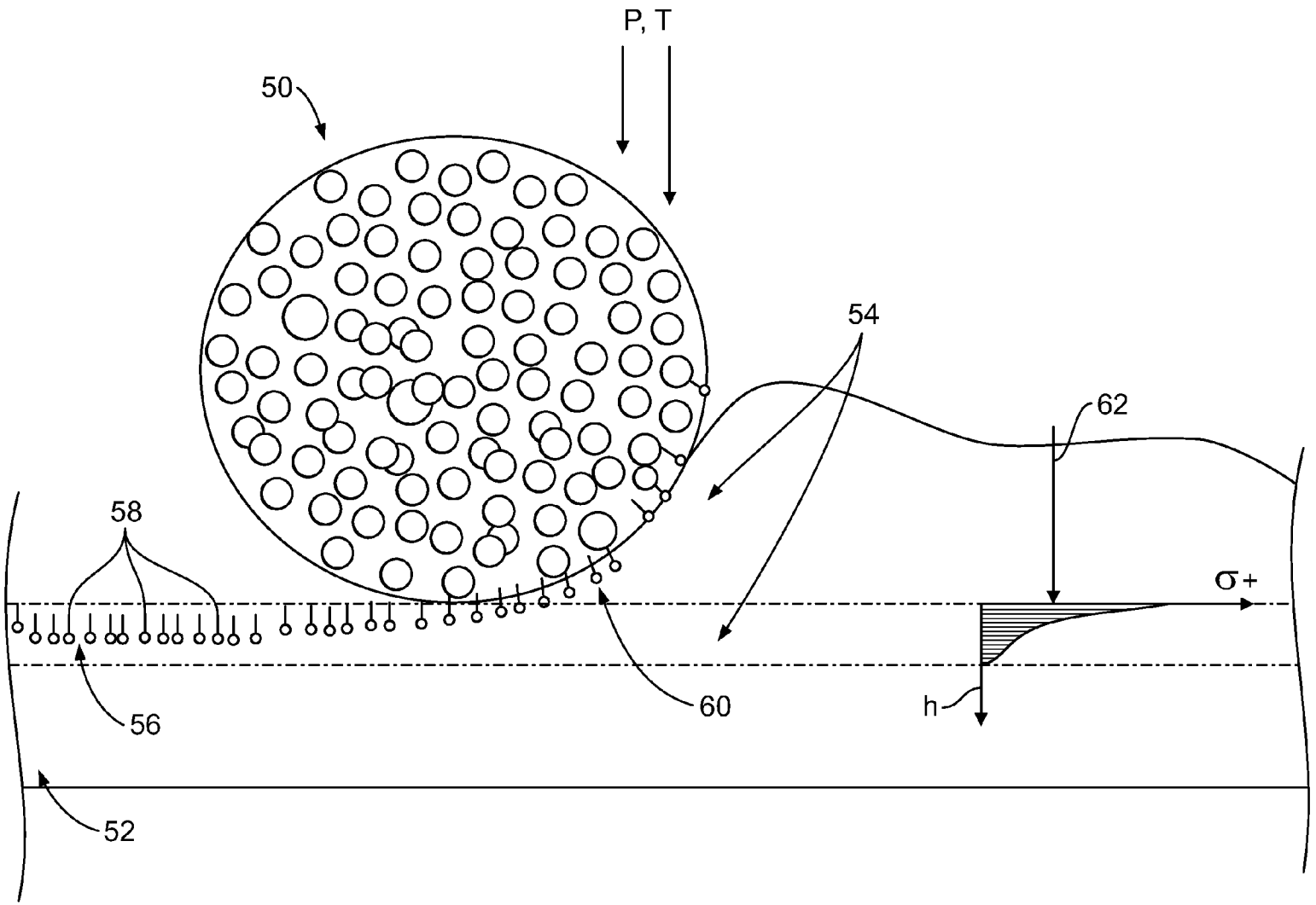
FIG. 5 shows a schematic view of the interaction process between the revitalizant nanostructure and the friction surface.

FIGS. 4 and 5 demonstrate the process of carbidization of the treated surface or friction surface.

Interaction between the revitalizant and the surface materials during the formation of the modified coating can be described as the formation of a cermet coating consisting mainly of metal carbides. It was experimentally detected that at this stage nanoscale dimensionality of the revitalizant nanoparticles ensures the dimensional effect of their mechanical interaction with the metal surface. This consists in the fact that the initial size of the revitalizant particles corresponds to the sizes of the surface defects (graininess, microroughness etc.). Such interaction causes nanoscale plastic deformation of the metal and conversion of the superficial layer into the active nanostructured state. This process is accompanied by intensive grinding of the metal grains, increase in density of their boundaries, improvement of conditions for carbon diffusion into the surface (vertically), and inside the grains (horizontally) (FIG. 4).

Thus, according to the proposed technical solution, the revitalizant nanoparticles act as pressure concentrators. The pressure of the revitalizant particles in the contact patterns with the surface is high, as its value is inversely proportional to the particle size (2-2,000 nm) raised to the second power, i.e. the nanostructured revitalizant forms unique P and T (pressure and temperature) conditions for intensive diffusion of carbon atoms inside the surface. These conditions facilitate the formation of carbides from the solution of carbon in iron (low-temperature carbidization). Such interaction is achieved owning to the nanoscale dimensionality of the revitalizant.

FIG. 5 illustrates the scheme of interaction between the revitalizant nanostructure 50 and the friction surface (main metal 52 and roughness of the surface layer 54 or restoration and 56 carbon saturation of the surface layer 58 with subsequent formation of carbides 60). There is also shown hardening of the surface due to the revitalizant nanostructures. This process comprises not only casehardening (carbidization) of the surface/modified layer 56, but also superficial hardening of the surface. This hardening is peculiar due to the formation compressive stresses of constant signs 62 through the whole depth of the modified layer 56. Traditional superficial plastic deformation of parts is carried out though grinding, roller burnishing, with the help of steel balls, or by means of other known methods. Such mechanical hardening creates compressive (positive) residual stresses in the surface layer of parts, which lead to the increase in fatigue limit and surface hardness, decrease in surface roughness 54 (it tends to 0) as well as elimination of surface microdefects.

Figure 6:
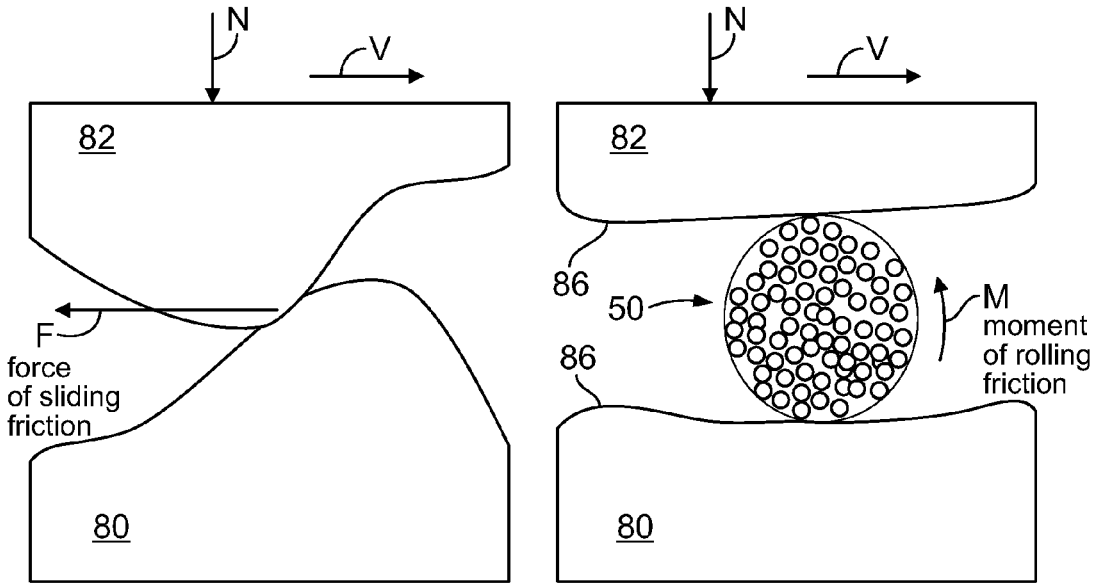
FIG. 6 shows a schematic view of the process of reducing friction losses.

FIG. 6 schematically demonstrates the process of reducing friction losses, wherein 80 and 82 are respectively non-movable and movable surfaces of the parts; N—load; V—velocity of relative movement; Fтр. ск.—force of sliding friction; Mтр. кач .—moment of rolling friction. There appears force of sliding friction on the contact patterns of the surfaces owning to their mechanical deformation and adhesion. As a result of interaction between the revitalizant 50 and the surfaces 86, the latter are getting smooth (their roughness decreases), which in itself reduces the friction losses. The revitalizant particles act as rolling elements, nanoscale "roller bearings". They convert the sliding friction of the parts, which causes high friction losses, into the rolling friction with significantly lower friction losses.

Figure 7:
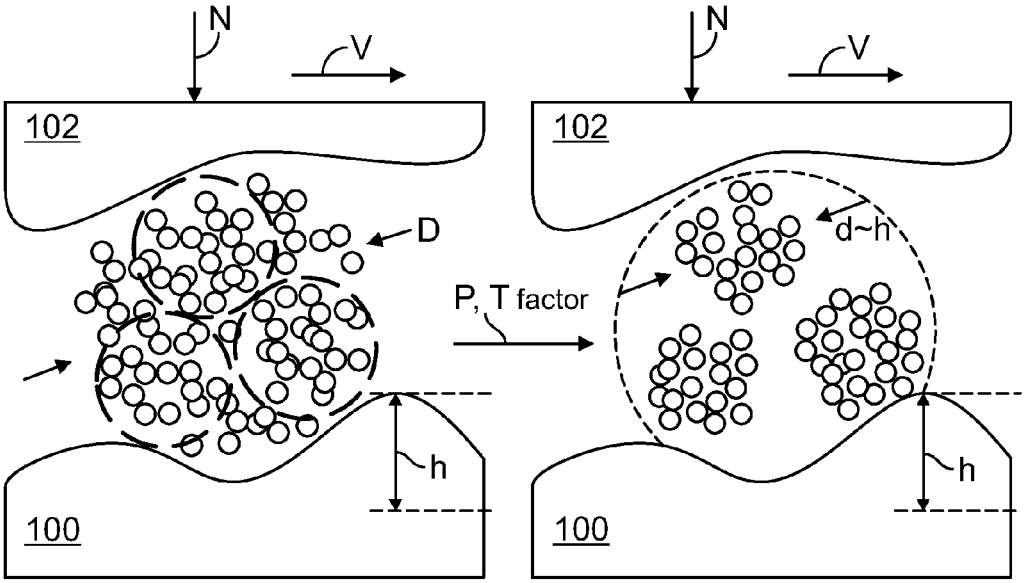
FIG. 7 shows a schematic view of the self-organization of the sizes of the particles of the revitalizant nanostructure.

FIG. 7 shows self-organization of the sizes of the particles of the revitalizant nanostructure, wherein the process of self-organization of the particles size of the revitalizant nanostructure adapts to the size of the surface roughness under the impact of P and T factor. 100—non-movable surface; 102—movable surface; N—load; V—velocity of movement.

The initial dimension of the particle of the revitalizant nanostructure D exceeds the typical dimension of the surface roughness h. Under the impact of P and T factor the initial dimension of the particle D is reduced to the optimal value d, which corresponds to the typical dimension of the roughness h. Change of the dimensions of the particle of the revitalizant nanostructure is accompanied by simultaneous change of the surface roughness. During stabilization of the modified layer the surfaces acquire the so-called equilibrium roughness, while the revitalizant nanostructure obtains dimensionality corresponding to this roughness and loading conditions N, V, i.e., the sizes of the particles of the revitalizant nanostructure adapt to the conditions of operation of coupling.

This is the nanoscale dimensionality of the particles of the revitalizant nanostructure, which determines new properties of the coating that is being formed (high superficial hardness, low roughness, involvement of wear products into the cermet coating and significant friction reduction at the final stage of the revitalization of the friction surface). Such nanoscale dimensionality allows nonabrasive interaction between the revitalizant and the treated surfaces as well as simultaneous self-adapting reduction of the dimensions of the particles of the revitalizant nanostructure during the final stage of the process (without development of solid coke formations).

General Conditions for Constructing the Revitalizant Nanostructure According to the Proposed Technical Solution The revitalizant nanostructure, which was derived from the dehydration products of the natural and/or synthesized hydrates and/or their mixtures at the temperature of bound water removal and at the temperature of stabilization of the dehydration product ranging from 300 to 1200° C., in a stable state contains oxides from the range: MgO and/or SiO2 and/or Al2O3 and/or CaO and/or Fe2O3 and/or K2O and/or Na2O, and is a conglomerated two-phase pomegranate-like formation consisting of voluminous contacting non-miscible substances: binding phase and grains.

The binding phase is composed of a homogeneous mixture of several oxides from the range: MgO and/or SiO2 and/or Al2O3 and/or CaO and/or Fe2O3 and/or K2O and/or Na2O, and the grain is constituted of one or several oxides from the range: MgO and/or SiO2 and/or Al2O3 and/or CaO and/or Fe2O3 and/or K2O and/or Na2O.

Volume size of the binding phase of the conglomerated formation fluctuates from 10 to 100,000 nm and depends on the dimensions of the initial particles of natural and/or synthesized hydrates and/or their mixtures.

Volume sizes of the grain particles ranging from 2 to 2,000 nm are conditional upon the temperature and time, to the influence of which the substance of the natural and/or synthesized hydrates or their mixtures has been exposed.

The durability of the binding phase is less than that of the grains. The binding phase prevents the grains from contacting witch each other.

The distances between the adjacent nanoparticles of the grains depend on the temperature and time conditions under which the removal of bound water molecules from natural and/or synthesized hydrates and/or their mixtures has taken place.

Examples of the Revitalizant Nanostructure

An example of the revitalizant nanostructure is the revitalizant nanostructure, which was obtained from the dehydration products of natural hydrates at the bound water removal temperature of 450° C. and at the temperature of stabilization of the dehydration product being 1,100° C., which in a stable state contains the metal oxides MgO, SiO2 and Al2O3 and is a conglomerated pomegranate-like two-phase formation consisting of voluminous contacting immiscible substances: binding phase and grains (FIG. 3).

The binding phase is composed of the homogeneous mixture of the oxides MgO and SiO2, and the grain is comprised of the oxide Al2O3.

The average volume size of the conglomerated formation containing the binding phase is within the range from 3,500 to 4,000 nm and depends on the dimensions of the initial particles of the natural hydrates and the temperature of bound water removal.

The average volume size of the grain particles, which is approximately 10 nm, depends on the temperature and time conditions under which the natural and/or synthesized hydrates and their mixtures have been stabilized.

The durability of the binding phase is less than that of the grains. The binding phase prevents the grains from contacting.

The distance between the adjacent nanoparticles of the grains (Al2O3) comprises 2-50 nm and depends on the temperature and time conditions of removal of the bound water molecules.

Examples of Practical Application of the Revitalizant Nanostructure

The revitalizant nanostructure is included into the lubricating compound applied for treatment of the gasoline engine with the capacity of 85 kW where motor oil with SAE 10W-40 viscosity according to the SAE J300 standard and the ACEA A3 performance properties according to the ACEA standard is applied.

The lubricating compound comprises the lubricating medium in form of mineral oil and the revitalizant nanostructure derived through dehydration of hydrates of natural minerals or a mixture of natural minerals, or of synthesized hydrates, wherein the dehydration product contains the oxides MgO, SiO2 and Al2O3 obtained through removal of bound water and destruction of the crystal lattice at the temperature of 750° C. The stable phase of the dehydration product is achieved due to its exposing to the influence of temperature of 1000° C. during 120 min., which allows obtaining the grain of the decomposition product, whose dimensions are within the range from 50,000 to 60,000 nm.

The engine was treated with the lubricating compound containing the revitalizant nanostructure. The effectiveness of the proposed nanostructure was evaluated through comparing operational characteristics of the engine before and after the treatment. Such aspects as toxicity of exhaust gases, fuel consumption, engine power and compression were subject to comparison.

Measurement of toxicity of exhaust gases (CO, HC, NOx, CO2) was conducted in accordance with Directive 70/220/EEU i. d. F. 2006/96/EC Type I. The application of the lubricating compound containing the revitalizant nanostructure caused positive change in emissions of carbon oxide, carbon dioxide and hydrocarbon (Table 1). The change of the average value from 1.250 g CO/km to 1.051 g CO/km corresponds to the reduction of carbon oxide emission by 15.92%. The change of the average value from 173.247 g CO2/km to 164.319 g CO2/km corresponds to the reduction of carbon dioxide emission by 5.16%. The change of the average value from 0.118 g HC/km to 0.109 g HC/km corresponds to the reduction of hydrocarbon emission by 7.63%. The reduction of nitrogen oxide was not detected within the experiment.

TABLE 1

Comparison of average values of toxicity before and after application of lubricating compound containing revitalizant nanostructure.

| No. | Toxicity value | Before treatment, g/km | After treatment, g/km |
|---|---|---|---|
| 1 | Average value, CO | 1.25 | 1.051 |
| 2 | Average value, $CO_2$ | 173 | 164 |
| 3 | Average value, HC | 0.118 | 0.109 |
| 4 | Average value, NOx | 0.084 | 0.087 |

Determination of fuel consumption was conducted in accordance with Directive 80/1268/EEU i. d. F. 2004/3/EC. Through comparative analysis it was found out that fuel consumption decreased after the application of the lubricating compound containing the revitalizant nanostructure (Table 2). The change of the average value from 7.351 l/100 km to 6.962 l/100 km corresponds to the reduction of fuel consumption by 5.29%.

TABLE 2

Comparison of average values of fuel consumption before and after application of lubricating compound containing revitalizant nanostructure.

| No. | Value | Before treatment, 1/100 km | After treatment, 1/100 km |
|---|---|---|---|
| 1 | Average value of fuel consumption | 7.351 | 6.962 |

Measurement of the engine power was carried out in accordance with Directive 80/1269/EEU i. d. F. 1999/99/EC. It was detected that the application of the lubricating compound containing the revitalizant nanostructure caused increase of the engine power (Table 3). The change of the engine power from 85.6 kW to 87.9 kW corresponds to the increase by 2.68% or 2.3 kW.

TABLE 3

Comparison of average values of engine power before and after application of lubricating compound containing revitalizant nanostructure.

| No. | Value | Before treatment, | After treatment, |
|---|---|---|---|
| 1 | Engine power, kW | 85.6 | 87.9 |

Determination of compression was conducted with the help of a self-recording device for compression measurement. The application of the lubricating compound containing the revitalizant nanostructure increased the engine compression (Table 4). The initial measurements carried out before the application of the compound had demonstrated uneven compression pressure; deviations in separate cylinders had been up to 2 atm. After the application of the compound the compression pressure was leveled. Compression deviations in separate cylinders became insignificant. Besides, it was detected that the compression pressure in cylinders 2 and 3 significantly increased.

TABLE 4

Average values of compression in separate cylinders before and after application of lubricating compound containing revitalizant nanostructure.

| Cylinder No. | Compression value before treatment, bar | Compression value after treatment, bar |
|---|---|---|
| 1 | 12.6 | 14.1 |
| 2 | 9.6 | 14.1 |
| 3 | 9.3 | 14.4 |
| 4 | 11.6 | 14.5 |

General Conditions for Implementing the Method of Obtaining the Stable Form of the Revitalizant Nanostructure in Accordance with the Proposed Invention The method for obtaining the stable form of the revitalizant nanostructure comprising: dehydration of natural and/or synthesized hydrates and/or their mixtures at the temperature of the bound water removal ranging from 300 to 900° C., stabilization of the dehydration product at the temperature from 700 to 1,200° C. during 1-3 hours, mixing of the obtained product with the lubricating medium containing groups of the oxides from the range MgO and/or SiO2 and/or Al2O3 and/or CaO and/or Fe2O3 and/or K2O and/or Na2O, introduction of this mixture onto the friction surface or into the friction zone. The proposed stable form of the revitalizant nanostructure, whose dimensions range from 100 to 100,000 nm, is peculiar due to the fact that it turns into the stable form of rolling depending on the specific pressure on the friction surface and the temperature in the friction zone.

Example of Implementing the Method for Obtaining the Stable Form of the Revitalizant Nanostructure The example of implementing the method for obtaining the stable form of the revitalizant nanostructure consists in the formation of the conglomerated two-phase pomegranate-like structure comprised of the voluminous contacting immiscible substances: binding phase and grain. This structure converts itself into the form of "rolling nanobearing" after having reached the friction area or friction unit. The process of such conversion depends on the lubrication interval or friction rate.

For example, the substance consisting of the natural hydrates MgO, SiO2 and Al2O3 is put on the sample holder of the derivatograph chamber. The electronic photography of the initial particle of the natural hydrate shown on FIG. 2 demonstrates its homogeneity. The bound water is removed at the temperature of 450° C. Then the product is being exposed to the influence of the temperature of 1,100° C. during 145 min. Removal of the bound water from the hydrate particles and subsequent exposing to the temperature impact cause destruction of the integrity of the hydrate initial particles and formation of the amorphous pomegranate-like nanostructure, which is made up of the binding phase and the grains (FIG. 3). The binding phase being the homogeneous mixture of the oxides MgO and SiO2 prevents the grains consisting of Al2O3 from contacting. The average size of the binding phase being 3,500-4,000 nm is determined by the size of the initial particles of the natural hydrates and by the temperature of bound water removal taking place at 450° C. The average volume size of the particles equaling approximately 10 nm is provided through subsequent exposing to the influence of the temperature of 1,100° C. within 145 min. The distance between the adjacent nanoparticles of the grains (Al2O3) ranges from 2 to 50 nm and is determined by the said temperature and time conditions of the removed bound water molecules removal and subsequent exposing.

The stable form of the revitalizant nanostructure having the size of the grain from 2,500 to 5,000 nm after the process of stabilization is included into the lubricating compound. The lubricating compound is introduced into the friction zone or friction unit and is designed for improvement of tribological properties of the coupling parts lubricated with the motor oil: reduction of the friction coefficient and wear intensity. The action of the lubricating compound is based on physical and chemical interaction of the surfaces of the friction parts in the presence of the lubricating compound during operation. The action of the lubricating compound results in the change of properties (modification) of the surfaces of the friction parts if compared with the initial properties (before the application of the compound).

Derivation of the stable geometric form (form of rolling), which develops after the stabilized dehydration product has been introduced onto the friction surface or into the friction zone, depends on the lubrication interval or temperature rate, wherein: h≤Ra≤the size of the stabilized revitalizant nanostructure, where h—thickness of the lubricating layer or distance between two friction surfaces, Ra—roughness of the surface.

The size of the stabilized revitalizant nanostructure ranges from 2,500 to 5,000 in accordance with the general principles for deriving the stable form of the revitalizant nanostructure (form of rolling) or "rolling nanobearings", wherein h≤Ra≤the size of the stabilized revitalizant nanostructure (100-100,000 nm) or h=Ra≤the size of the stabilized revitalizant nanostructure (100-100,000 nm).

Table 5 demonstrates the examples for obtaining the stable geometric form of the revitalizant nanostructure (form of rolling) in various friction units and friction surfaces.

TABLE 5

| No. | Unit, mechanism | Lubrication interval (conditions) | h - lubricating layer thickness or distance between two friction surfaces, mkm | Ra - surface roughness, mkm | Size of stabilized revitalizant nanostructure, nm |
|---|---|---|---|---|---|
| 1 | Cylinder wall of internal combustion engine - piston ring (upper dead point) | boundary lubrication interval (boundary friction rate) h < Ra ≤ P | 0.02 | 0.1 | 2 500 |
| 2 | Slide-guide of metal-cutting machine | mixed lubrication interval(mixed friction rate) h ~ Ra ≤ P | 0.5 | 0.5 | 50,000 |

Table 6 illustrates the example of implementing the method for obtaining the stable form of the revitalizant nanostructure, which after having reached the friction area or the friction unit organizes itself into the form of "rolling nanobearing" at the lubrication interval or friction rate wherein h tends to 0, Ra≤the size of the stabilized revitalizant nanostructure (100-100,000 nm). This table also contains the example of deriving the revitalizant nanostructure on the inner surface of the barrel bore of the rifled arm.

TABLE 6

| No. | Unit, mechanism | Lubrication intervals (conditions) | h - lubricating layer thickness or distance between two friction surfaces, mkm | Ra - surface roughness, mkm | Size of stabilized revitalizant nanostructure, nm |
|---|---|---|---|---|---|
| | Inner surface of barrel bore of rifled arm | dry friction h →0; Ra ≤ P | 0 | 0.06 | 500 |

The above-described revitalizant nanostructures obtained through dehydration of the natural and/or synthesized hydrates and/or their mixtures thereof, containing the oxides in the range: MgO and/or SiO2 and/or Al2O3 and/or CaO and/or Fe2O3 and/or K2O and/or Na2O, are applied by XADO Company (Kharkov, Ukraine; UA) in course of implementation of the "XADO-technology."

In accordance with the proposed "XADO-technology," the revitalizant nanostructures, which are not abrasive substances in this case, act as deformational and hardening elements. The formation of significant compressive stresses in the surface layer is confirmed through the data of X-ray tensometry (sin 2ψ-method). It is worth mentioning that, due to the application of the revitalizant, the effects of the surface layer hardening transfer to the nanolevel. Hence, the compressive stresses, which can normally be obtained only through grinding, in our case take place due to the so-called "nanogrinding", which is not abrasive and is present in the lubricating substance throughout the whole process of revitalization. The interaction of the revitalizant particles under the impact of P and T factor (high specific pressure and temperature) deforms the surface of the part, which leads to its hardening, smoothing and reducing of the roughness to the nanoscale level.

The description of the proposed technical solution manifests that the revitalizant nanostructure and the method for obtaining the stable form of the revitalizant nanostructure possess novelty, inventive step and industrial applicability.

The invention claimed is:

1. A revitalizant nanostructure composition, comprising:

a dehydration product of at least one of natural hydrates, synthesized hydrates, and their compositions, where the dehydration product is obtained after constitution water elimination and stabilization at a temperature from 300° C. to 1200° C.;

wherein in stable condition the revitalizant nanostructure includes at least one of the oxides MgO, $SiO_2$, $Al_2O_3$, CaO, $Fe_2O_3$, $K_2O$, and $Na_2O$, and where the revitalizant nanostructure has a polygranular shape including a binding phase and a plurality of nanograins, the binding phase having a size between about 100 nm and about 100,000 nm, the plurality of nanograins having sizes between about 2 nm and about 2,000 nm.

2. The revitalizant nanostructure composition of claim 1, wherein the temperature of constitution water elimination is in the range of 300° C.-1000° C.

3. The revitalizant nanostructure composition of claim 1, wherein the temperature of dehydration product stabilization is in the range of 700° C.-1200° C.

4. The revitalizant nanostructure composition of claim 1, wherein the revitalizant nanostructure is formulated from a product mixture including at least one of natural and synthesized hydrates.

5. The revitalizant nanostructure composition of claim 1, wherein the binding phase of the structureless grenade shape is formulated by at least one of the oxides MgO, $SiO_2$, $Al_2O_3$, CaO, $Fe_2O_3$, $K_2O$, and $Na_2O$.

6. The revitalizant nanostructure composition of claim 1, wherein at least some of the plurality of nanograins are formulated from at least one of the oxides MgO, $SiO_2$, $Al_2O_3$, CaO, $Fe_2O_3$, $K_2O$, and $Na_2O$.

7. The revitalizant nanostructure composition of claim 1, wherein the revitalizant nanostructure contains nanoparticles having a hardness of about 7-10 units on the Mohs scale.

* * * * *